US008300871B2

(12) United States Patent
Welsh et al.

(10) Patent No.: US 8,300,871 B2
(45) Date of Patent: Oct. 30, 2012

(54) EARPHONE FOR WIDEBAND COMMUNICATION

(75) Inventors: Christopher T. Welsh, Fishers, IN (US); Larry A. Marcus, Fishers, IN (US); John C. Baumhauer, Jr., Indianapolis, IN (US)

(73) Assignee: MWM Acoustics, LLC, Indianapolis, IN (US)

( * ) Notice: Subject to any disclaimer, the term of this patent is extended or adjusted under 35 U.S.C. 154(b) by 1123 days.

(21) Appl. No.: 11/935,290

(22) Filed: Nov. 5, 2007

(65) Prior Publication Data

US 2009/0116676 A1 May 7, 2009

(51) Int. Cl.
*H04R 25/00* (2006.01)

(52) U.S. Cl. ..... 381/371; 381/370; 381/182

(58) Field of Classification Search ..... 381/309, 381/380, 370, 371, 373, 182, 186, 345, 349; 379/430, 433.01, 433.02, 432; 181/129, 181/135, 144

See application file for complete search history.

(56) References Cited

U.S. PATENT DOCUMENTS

| | | | | |
|---|---|---|---|---|
| 3,943,304 | A * | 3/1976 | Piribauer | 381/99 |
| 4,418,248 | A * | 11/1983 | Mathis | 381/373 |
| 4,965,836 | A * | 10/1990 | Andre et al. | 381/370 |
| 6,658,110 | B1 * | 12/2003 | Andersen | 379/433.02 |
| 2006/0133636 | A1 * | 6/2006 | Harvey et al. | 381/380 |

OTHER PUBLICATIONS

Joe Shambro, Ultimate Sound, Ultimate Ears: A Look Inside Ultimate Ears' Legendary Quality, available at http://homerecording.about.com/od/interviewtipstricks/a/ultimateearsl.htm.

* cited by examiner

*Primary Examiner* — Huyen D Le
(74) *Attorney, Agent, or Firm* — Ice Miller LLP

(57) ABSTRACT

An earphone device capable of achieving sound bandwidths beyond the 150-7000 Hz wideband range, and configured for supra-concha or supra-aural placement. The earphone comprises at least two frequency range receivers positioned within a housing. In at least one embodiment, the earphone is capable of achieving a super-wideband range by physically combining a low frequency range receiver and a high frequency range receiver in a space-efficient and acoustically advantageous manner.

21 Claims, 5 Drawing Sheets

EARPHONE FOR WIDEBAND COMMUNICATION

BACKGROUND

Dating back to the 1880s, communication and telecommunication close-coupled ear "receiver" technology was largely limited to "narrowband" devices delivering sound to the ear between approximately 300-3300 Hz. Over the last twenty years, the industry has introduced "wideband" instruments capable of achieving a 150-7000 Hz bandwidth range. While the wideband technology was able to achieve an increase in bandwidth over the earlier narrowband technology, the range still falls short of the 20-20,000 Hz range that can be achieved by human speech and hearing.

This wideband technology has now matured in performance and availability to achieve significant consumer acceptance. Nevertheless, recent major advances in digital electronics and voice communication facilities bandwidth have given rise to a desire to mimic the "hi-fi" industry (i.e. to utilize the full spectral capability of human hearing) not only for voice, but for music as well. Thus, it is desirable to provide audio receiver technology that goes beyond even 150 Hz-7 kHz wideband range.

Conventional wideband supra-aural and supra-concha earphones, headsets, and handsets use a single receiver transducer to cover the 150-7000 Hz bandwidth range. It is difficult to achieve response bandwidths outside of this wideband frequency range due to, among other reasons, (i) ear leakage, (ii) constraints on the product's interior housing air volume, and (iii) the relatively high mass and thus low resonance frequency of the receiver diaphragm, which results in a limited upper frequency response range.

Historically, hi-fidelity speaker systems and commercially available in-canal earphones use multiple transducers to deliver sound over different portions of the frequency spectrum. Such speaker systems work into an entirely different complex acoustical load impedance than the ear load of supra-concha and supra-aural earphones, and such speaker systems are not constrained in size. Similarly, small intra-concha (ear-bud) and insert (canal) earphone products exist that use dual-drive transducers. These very small earphones drive directly into the relatively low volume and thus acoustically-stiff ear canal, as opposed to the lower stiffness and far larger air volume of the human outer ear seen by supra-aural and supra-concha earphones. In addition, the outer ear also allows sound to leak to the ambient. Therefore, earphones that are designed to be worn in a supra-concha or supra-aural fashion require far greater electro-acoustic efficiency and physical size than that required by their intra-concha and insert counterparts. Accordingly, it would be desirable to provide a supra-concha or supra-aural audio receiver technology that is capable of going beyond the conventional 150-7000 Hz wideband range in spite of the difficulties imposed by the low acoustical impedance of the large air volume of the outer ear and the associated sound leakage to the ambient.

DETAILED DESCRIPTION

Figure 1:
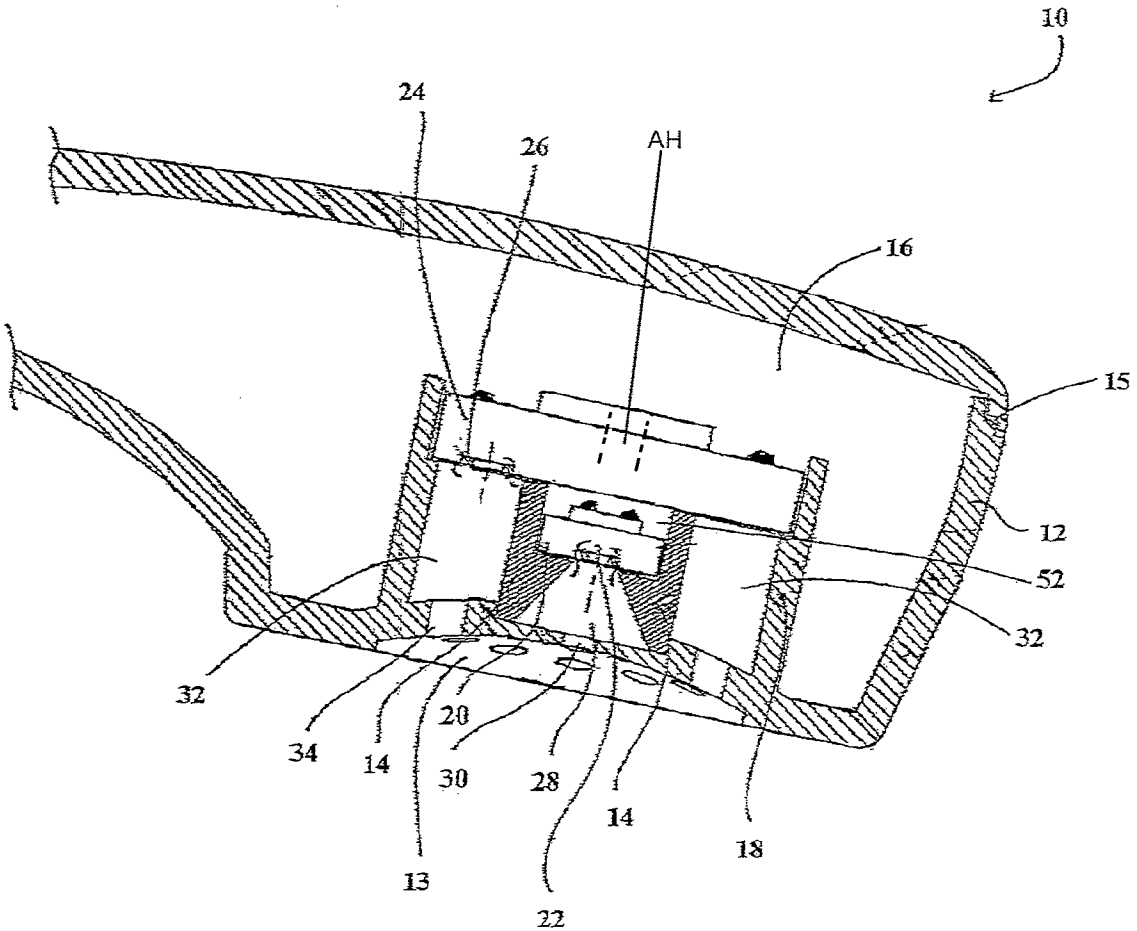
FIG. 1 shows a cross-sectional view of one embodiment of a earphone.

Reference will now be made to the embodiments illustrated in the drawings and specific language will be used to describe the same. It will nevertheless be understood that no limitation of scope is intended by the description of these embodiments.

FIG. 1 shows a cross-section of one embodiment of an earphone 10. The earphone 10 is capable of extending the bandwidth beyond those bandwidths produced by conventional receivers, at both high and low frequencies, by physically combining a low frequency range receiver and a high frequency range receiver in a space-efficient and acoustically advantageous manner. Specifically, the earphone 10 is capable of achieving bandwidths with "super-wideband" range of from about 75 Hz to about 18,000 Hz. The earphone may be used for reduced bandwidth ranges, such as those beginning at from about 150 Hz and those ending at about 14,000 Hz, or any other desired sound bandwidth.

In one embodiment, the earphone 10 includes an earphone housing 12, a high frequency range receiver 20 (the "HFR 20"), and a low frequency range receiver 24 (the "LFR 24"). The earphone housing 12 is formed in a manner to rest against a user's ear and may house the HFR 20 and the LFR 24.

In one embodiment, the LFR 24 is a moving-coil or "dynamic" type of electrical-to-acoustical transducer and the HFR 20 is a moving-coil or "dynamic" type electrical-to-acoustical transducer. In this embodiment, the LFR 24 response may span from about 75 Hz to about 4,000 Hz, and the HFR 20 may span from about 4,000 Hz to about 18,000 Hz. In addition, the natural resonance frequencies (Fo) of the LFR 24 and HFR 20 may be about 340 Hz and about 460 Hz, respectively. The LFR 24 of this embodiment may further exhibit an electroacoustic efficiency of about 108 dBSPL/1.0 mW through use of a B&K 4195, ITU-T P.57 type 3.2 "high leak" coupler, and the HFR 20 may exhibit an electroacoustic efficiency of about 112 dBSPL/1.0 mW through use of a B&K 4153, IEC Standard 318-type (no leak) coupler. In yet another embodiment, the LFR 24 further comprises a 32 mm diameter DTR 32L-WB-LF receiver from MWM Acoustics, LLC and the HFR 20 further comprises a 11 mm LS 1149-LF from MWM Acoustics, Inc.

The earphone 10 may optionally be coupled to a crossover circuit (not shown) which receives the communication signal and distributes it to the earphone 10. The crossover circuit may be housed within the earphone housing 12 or positioned independent of the earphone 10. The crossover circuit is electronically coupled with the HFR 20 and the LFR 24 and may comprise any crossover circuit capable of distributing a wideband drive signal to the HFR 20 and/or the LFR 24, such as a passive circuit. For example, in one embodiment, the HFR 20 and the LFR 24 are arranged in parallel, and one simple solution is to simply place a capacitor directly in series with the HFR 20 so as to high-pass filter the HFR response above, for example, 4,000 Hz. Alternately, a crossover function may optionally be programmed into a digital signal processor either placed within or placed outside of the earphone housing 12.

The HFR 20 comprises any electrical-to-acoustical transducer known in the art that is capable of receiving and converting a drive signal into high frequency sound waves. The HFR 20 further comprises at least one high frequency receiver sound hole 22 positioned on the front of the HFR 20, and at least one auxiliary hole (not shown) positioned on the rear of the HFR 20. The HFR 20 is electronically driven by the crossover circuit. The LFR 24 is likewise driven by the crossover circuit and may comprise any electrical-to-acoustical transducer known in the art that is capable of receiving and converting a drive signal into low frequency sound waves. The LFR 24 further comprises at least one low frequency receiver hole 26 positioned on the front of the LFR 24, and at least one auxiliary hole AH (shown in FIG. 1) positioned on the rear of the LFR 24. In one embodiment, the HFR 20 and LFR 24 are common moving-coil ("dynamic") type receivers. Auxiliary holes lower the acoustic stiffness or load on the moving diaphragms of the HFR 20 and the LFR 24, thereby enhancing the sensitivity of the HFR 20 and the LFR 24 by acoustically venting volume velocity to the sealed cavity 52 and the interior cavity 16, respectively.

The earphone housing 12 defines an interior cavity 16 and comprises a scoop portion 13, an inner housing member 14, a housing belt line 15, and a protrusion 18. While the earphone housing 12 is shown as a supra-aural type housing in FIG. 1, it will be appreciated that the earphone housing 12 may be of any type known in the art that does not intrude upon the intra-concha cavity or the ear canal. For example, the earphone housing 12 may comprise a supra-concha type that rests on the ridges of the concha cavity.

The scoop portion 13 comprises an indentation and corresponding air cavity and is positioned on the earphone housing 12 such that the scoop portion 13 partially bounds the interior cavity 16 of the earphone housing 12. The scoop portion 13 may be configured such that when the earphone 10 is in use, the scoop portion 13 is capable of easily resting against a user's ear pinna. In one embodiment, the air cavity of the scoop portion 13 has a volume of about 0.50 cubic centimeters.

The housing belt line 15 comprises a gap in the earphone housing 12 that allows sound to communicate between the interior cavity 16 and the ambient surrounding the earphone housing 12. The inner housing member 14 of the earphone housing 12 is positioned proximate to the scoop portion 13 within the interior cavity 16. The inner housing member 14 is capable of supporting the HFR 20 in a position such that the high frequency range receiver sound hole or holes 22 face toward the scoop portion 13 and the auxiliary holes of the HFR 20 face in the opposite direction. The inner housing member 14 may be an extension of the earphone housing 12 or may comprise a separate component that is coupled with the apex of the scoop portion 13. The inner housing member 14 further comprises a high frequency resonator cavity 28 that communicates with the exterior of the earphone housing 12 through at least one high frequency resonator port 30. The at least one high frequency resonator port 30 may comprise any diameter that is sufficient to allow communication between the high frequency resonator cavity 28 and the exterior of the earphone housing 12, and, in one embodiment, each of the at least one high frequency resonator ports 30 comprises a diameter of about 3.0 millimeters. In one embodiment, the high frequency resonator cavity 28 comprises a cone-shaped cavity, with the conical base positioned proximate to the high frequency resonator ports 30. The combination of the high frequency resonator cavity 28 and the high frequency resonator ports 30 forms a high frequency acoustic resonator 40.

The protrusion 18 may either comprise an extension of the earphone housing 12 or a separate component coupled with the earphone housing 12. In both embodiments, the protrusion 18 protrudes from the earphone housing 12 into the interior cavity 16. In one embodiment, the protrusion 18 extends around the interior perimeter of the scoop portion 13 such that it forms a cylindrical projection within the interior cavity 16 of the earphone housing 12. The protrusion 18 is capable of securely supporting the LFR 24 in a position where the low frequency range receiver sound holes 26 face toward the scoop portion 13 and the auxiliary holes of the LFR 24 face in the opposite direction. The protrusion 18 is comprised of a height sufficient to support the LFR 24 in tandem with the HFR 20 (i.e. one in front of the other) with respect to a user's ear.

The location of the protrusion 18 and the LFR 24 relative to the high frequency acoustic resonator 40 forms a low frequency resonator cavity 32 that communicates with the exterior of the earphone housing 12 through at least one low frequency resonator port 34. Accordingly, the earphone 10 may comprise more than one low frequency resonator port 34, and in at least one embodiment, the earphone 10 comprises twelve low frequency resonator ports 34. Each of the at least one low frequency resonator ports 34 may comprise any diameter that is sufficient to allow communication between the low frequency resonator cavity 32 and the exterior of the earphone housing 12, and, in one embodiment, each of the at least one low frequency resonator ports 34 comprises a diameter of about 3.0 millimeters.

In the embodiment shown in FIG. 1, the low frequency resonator cavity 32 completely surrounds the inner housing member 14 and, therefore, the high frequency cavity 28. The combination of the low frequency resonator cavity 32 and the low frequency resonator ports 34 forms a low frequency acoustic resonator 50. Due to the placement of the LFR 24, the low frequency acoustic resonator 50 and the high frequency acoustic resonator 40 are physically separated and can only communicate via the high acoustical compliance of the scoop portion 13 cavity. Accordingly, the earphone 10 comprises two substantially independent acoustic resonators: the high frequency acoustic resonator 40 and the low frequency acoustic resonator 50.

Figure 1A:
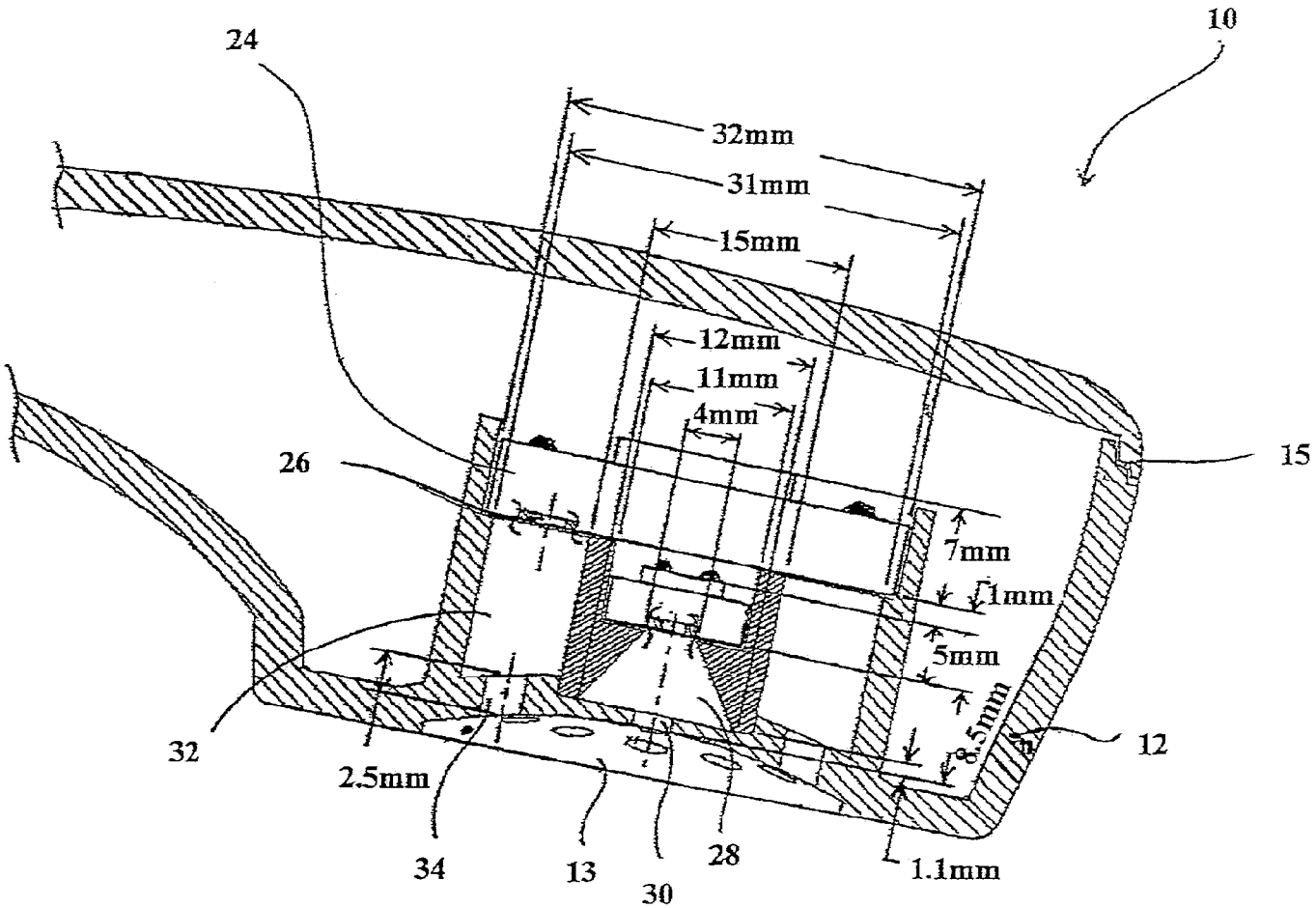
FIG. 1A shows a cross-sectional view of one embodiment of the earphone of FIG. 1.

Now referring to FIG. 1A, one embodiment the earphone 10 of FIG. 1 is again shown in a cross-sectional view. In addition to the various components of the earphone 10, FIG. 1A further illustrates the possible dimensions of one embodiment of the earphone 10. It will be recognized that although the earphone 10 in FIG. 1A is shown having certain dimensions, any dimensions can be used so long as the earphone 10 is capable of extending the bandwidth beyond those bandwidths produced by conventional receivers.

In operation, the communication signal, possibly modified by a crossover circuit or function, is distributed to the HFR 20 and the LFR 24. Pursuant to the signal received, the HFR 20 and the LFR 24 drive sound (volume velocity) out of the respective sound holes 22 and 26, through the resonator ports 30 and 34, and towards the user's ear. The HFR 20 sound and the LFR 24 sound converge in the scoop portion 13 of the earphone housing 12. In this manner, the high frequency acoustic resonator 40 driven by the HFR 20 and the low frequency acoustic resonator 50 driven by the LFR 24 interact acoustically through the juxtaposition of the scoop portion 13 and the high frequency and low frequency resonator ports 30 and 34. As such, the high and low frequency sounds are "mixed" in the scoop portion 13 of the housing 12 prior to entering the user's outer ear. The configuration of the HFR 20, the LFR 24, and the high and low frequency acoustic resonators 40, 50 in addition to the pre-mixing of the high and low frequency sounds in the scoop portion 13 cavity enables the delivery of sound to the user in the 75 Hz-18 kHz range.

Concurrently with driving sound through the sound holes 22 and 26, both the HFR 20 and the LFR 24 drive sound out of their auxiliary holes in a direction opposite of the scoop portion 13. In the case of the HFR 20, the rear sound is driven into a sealed cavity 52. In this embodiment, the sealed cavity 52 is formed by the junction of the LFR 24 and the inner housing member 14. The LFR 24 drives the rear sound into the interior cavity 16 of the earphone housing 12.

Because the LFR 24 drives long-wavelength sound, the interior cavity 16 must comprise a sufficient volume to avoid excessive acoustical loading on the rear of the LFR 24's diaphragm. Such acoustical loading may be minimized by the housing belt line 15 as the housing belt line 15 allows some of the rearward long-wavelength sound to escape from the interior of the housing 12 into the surrounding ambient. If the response is required to go unusually low in frequency or if the interior cavity 16 is desired to be of a decreased size, the gap of the housing belt line 15 can be exaggerated so as to create significant acoustical leakage from the interior cavity 16 to the ambient. Exaggerating the housing belt line 15 has proven advantageous in the LFR 24 response, especially with respect to when the earphone housing 12 comprises a decreased size and therefore a smaller interior cavity 16. The electrical-to-acoustical transducers, namely the HFR 20 and the LFR 24, may comprise, but are not limited to, common moving-coil ("dynamic") type receivers.

Figure 2:
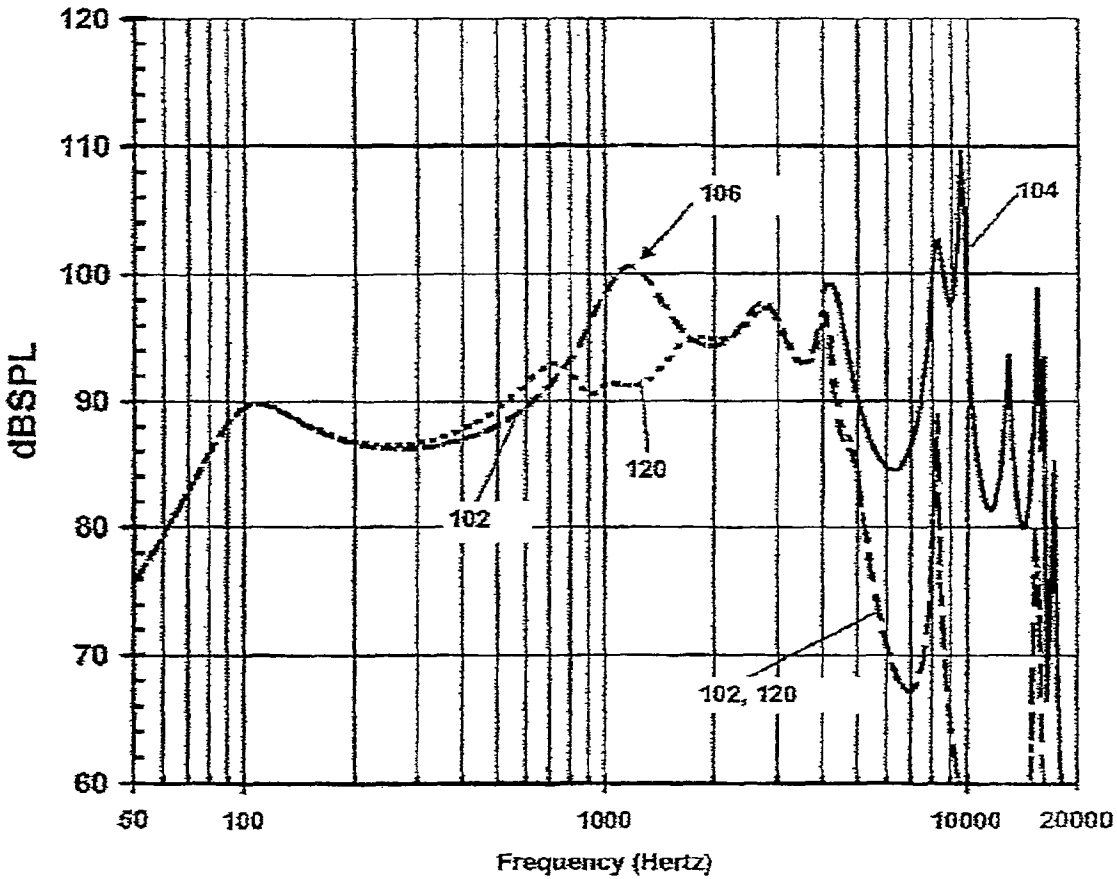
FIG. 2 shows a graph of response curves for the earphone of FIG. 1A.

Referring to FIG. 2, a graphical representation of the response curves for the operation of the earphone 10 of FIG. 1A is shown. FIG. 1A shows a cross-section view of the earphone 10 of FIG. 1 wherein specific dimensions are defined. The line graph of FIG. 2 represents the different response and resulting bandwidths produced by the HFR 20, the LFR 24, and the high and low frequency resonators 40, 50 of the earphone 10 over a range of frequencies. The x-axis of the line graph comprises frequency, shown in units of Hertz (and Kilo-Hertz), and the y-axis comprises units of sound pressure, shown in units of decibels. Specifically, the simulated data was generated at the Drum Reference Point ("DRP") of a human ear, which is located at the inner end of the ear canal on the ear drum. This ear coupler simulation is in conformance with the International Telecommunications Union standard ITU-T 3.2, High Leak, via a B&K 4195, High Leak apparatus.

Curve 102 represents the response of the LFR 24 and curve 104 represents the response of the HFR 20, where both the LFR 24 and the HFR 20 have been independently driven with 50 mV across the wideband range (above 4,000 Hz for the HFR 20). The curve 102 further comprises a response peak 106 near 1,150 Hz, representing the maximum response produced by the LFR 24 of the earphone 10. As the data illustrates, due to the arrangement of the high frequency acoustic resonator 40 relative to the low frequency acoustic resonator 50, the earphone 10 is able to achieve a combined bandwidth over the extended range of 75 Hz to 17 kHz. Furthermore, due to the configuration of the earphone 10, a low acoustical source impedance is ensured, as seen by the ear load looking back on earphone 10. It will be recognized that this low acoustical source impedance, relative to the ear load with shunting ear leakage to the ambient, advantageously avoids the loss of the low frequency sound response (i.e. bass response) due to ear leakage.

Figure 3:
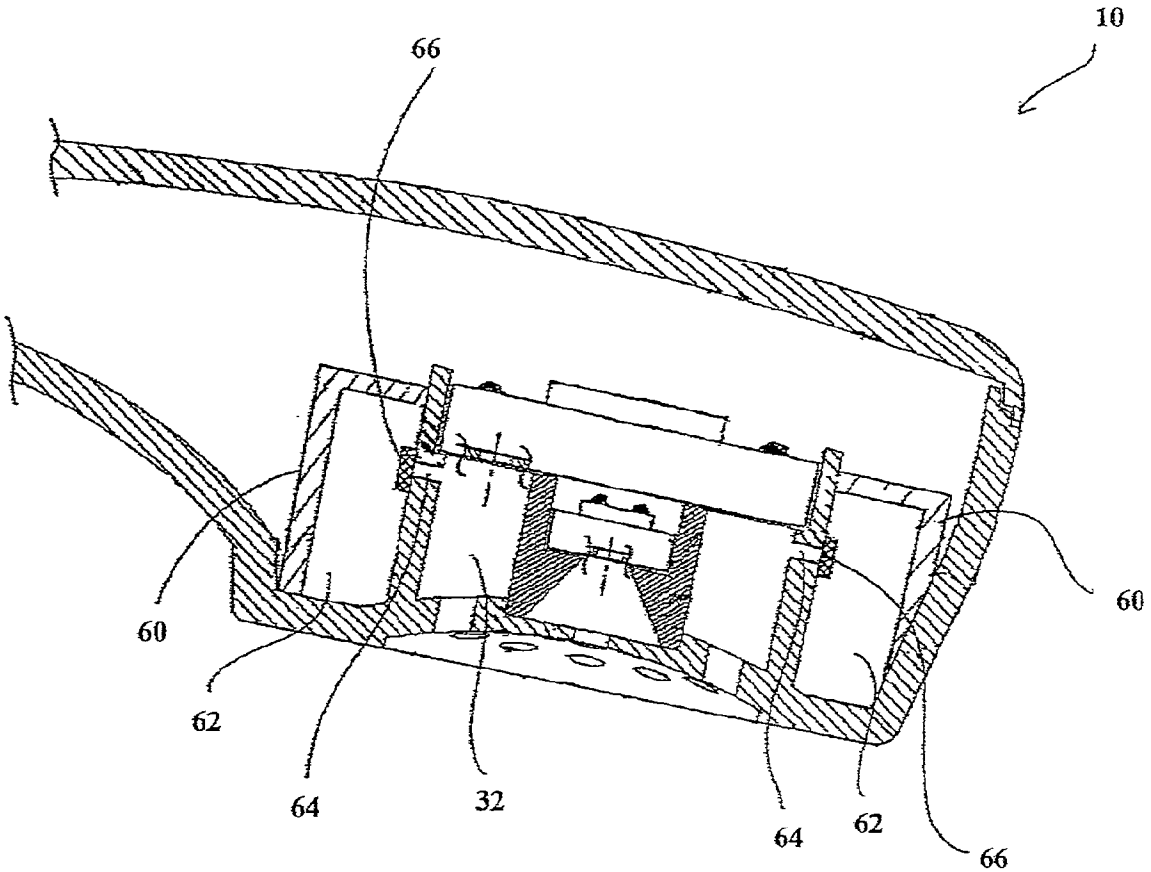
FIG. 3 shows a cross-sectional view of an additional embodiment of an earphone.

Now referring to FIG. 3, there is shown a cross-sectional view of an additional embodiment of the earphone 10. In FIG. 3, the earphone 10 further comprises a side-branch resonator 60. The side-branch resonator 60 is an acoustical filter capable of affecting the LFR 24 response by releasing sound waves from the low frequency resonator cavity 32 into a side-branch resonator cavity 62 through one or more side-branch resonator ports 64. The side-branch resonator 60 has proven advantageous in reducing the magnitude of the response peak 106 shown in FIG. 2, which, at the level illustrated on curve 102, could potentially yield an undesirable subjective listening affect.

The side-branch resonator 60 is an extension of the earphone housing 12 and protrudes therefrom into the interior cavity 16. The side-branch resonator 60 couples with the protrusion 18 such that a side-branch resonator cavity 62 is formed between the side-branch resonator 60 and the protrusion 18. In this manner, the side-branch resonator cavity 62 surrounds the low frequency resonator cavity 32 walls. It will be appreciated that the side-branch resonator cavity 62 may extend wholly or partially around the periphery of the low frequency resonator cavity 32 and thus may only be distributed on one or both sides of the low frequency resonator cavity 32 walls. The configuration of the side-branch resonator cavity 62 is dependent on the desired volume of the side-branch resonator cavity 62 so as to tune the side-branch resonator cavity 62 to achieve a desired frequency (e.g., 1150 Hz).

In the embodiment shown in FIG. 3, the earphone 10 may further comprise at least one side-branch resonator port 64 on the protrusion 18 with a corresponding side-branch resonator damping material 66 coupled thereon. The side-branch resonator ports 64 may vary in size and depth, and any number of side-branch resonator ports 64 may be used. The side-branch resonator port 64 may communicate with the side-branch resonator cavity 62 and the low frequency resonator cavity 32. The side-branch resonator damping material 66 dampens the flow of sound waves through the side-branch resonator ports 64, the extent of which depends on the configuration and composition of the side-branch damping material 66.

The combination of the dimensions of the side-branch resonator 60, the number, size, and depth of the side-branch resonator ports 64, and the composition and configuration of the side-branch resonator damping material 66 determine the degree of affect that the side-branch resonator 60 has on the response of the LFR 24. The proper specifications of the side-branch resonator 60 can significantly reduce the magnitude of the LFR 24 response peak to approximately 1150 Hz.

In operation, the side-branch resonator 60, typically having a cavity volume of from about 3 cc to about 12 cc, stores acoustical energy from the low frequency resonator cavity 32 in the side-branch resonator cavity 62. The side-branch resonator 60 "tunes" the flow of sound therein using the side-branch resonator ports 64, the side-branch resonator cavity 62, and the side-branch resonator damping materials 66. Accordingly, the total volume of the side-branch resonator cavity 62, the composition and configuration of the damping material 66, and the total number of side-branch resonator ports 64 are critical to determining how effectively the side-branch resonator 60 can alter the response peak 106 of the LFR 24. Referring back to FIG. 2, curve 120 represents the LFR 24 response when the earphone 10 further comprises the side-branch resonator 60 comprising the following dimensions: the side-branch resonator cavity 62 consisted of a single cavity of 6.4 cc total air volume accessed through four (4) ports of cross-section 1.4×4.7 mm by 4.2 mm deep and a cloth side-branch resonator damping material 66 having about 2.5 $Ns/m^3$ specific acoustical resistance.

Figure 4:
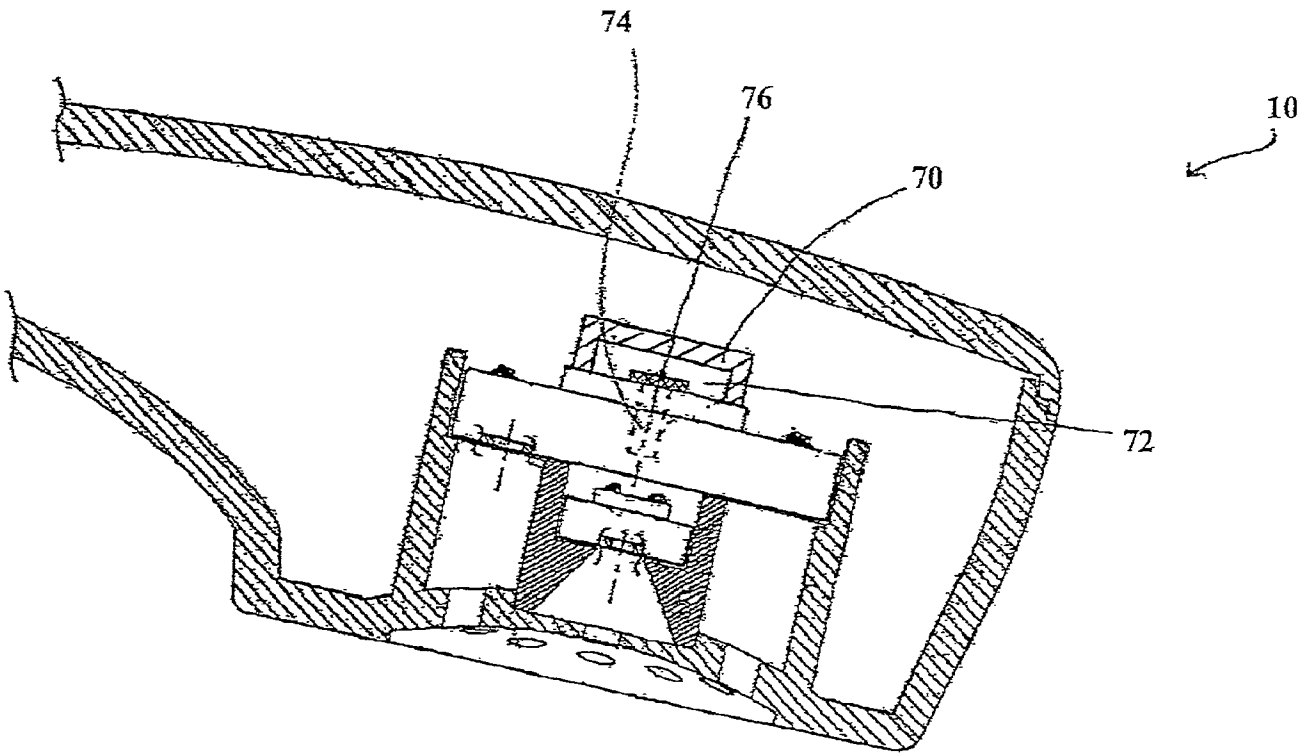
FIG. 4 shows a cross-sectional view of another embodiment of an earphone.

FIG. 4 shows an alternative embodiment of the earphone 10. As shown in FIG. 4, the earphone 10 further comprises the side-branch resonator 70. The side-branch resonator 70 comprises a side-branch resonator cavity 72, at least one side-branch resonator port 74, and at least one corresponding side-branch resonator damping material 76. The only differences between the side-branch resonator 60 of FIG. 3 and the side-branch resonator 70 of FIG. 4 is that the side-branch resonator 70 is positioned differently with respect to the LFR 24 and the side-branch resonator port 74 of the side-branch resonator 70 is one and the same with a hole that extends through an interior magnetic structure (i.e. pole pieces and possibly magnet) of the LFR 24. In this manner, the cavity 72 and hole (same as port 74) can acoustically communicate with the resonator cavity 32 through the LFR 24's diaphragm. Similar to side-branch resonator 60, the side-branch resonator 70 functions to tune the LFR 24 by releasing sound waves from the low frequency resonator cavity 32 into the side-branch resonator cavity 72 through the side-branch resonator port 74 and low frequency range receiver hole 26.

It will be appreciated by one of skill in the art that the earphone 10 may be used in conjunction with other acoustical devices known in the art, such as, but not limited to, a hearing aid with a magnetic pick-up option. The earphone 10 may be modified to raise its output magnetic H-fields such that the hearing aid can pick up the communication signal by placing a separate and auxiliary telecoil outside of the LFR 24. For example, a toroidal telecoil that is electrically in parallel with the LFR 24 may be placed around the exterior of the inner housing member 14 or the protrusion 18 to achieve the desired effect.

In the embodiments discussed herein, such an earphone allows a user to achieve "super-wideband" ranges of 75 Hz-18 kHz, while maintaining a relatively small earphone housing 12. The embodiments described herein are only offered by way of non-limiting examples, as other versions are possible. It is anticipated that a variety of other modifications and obvious changes will be apparent to those having ordinary skill in the art and such modifications and changes are intended to be encompassed within this description and the following and any later added claims.

The invention claimed is:

1. An earphone for placement against an ear pinna or on the ridges of an ear concha cavity, the earphone comprising:

a first frequency range receiver;

a second frequency range receiver electrically connected to the first frequency range receiver, wherein the first frequency range receiver and the second frequency range receiver are arranged physically in tandem with respect to the normal from the ear;

a housing having at least one wall forming a scoop cavity between the housing and the ear;

a first resonator cavity positioned outside of the first frequency range receiver within the housing;

a second resonator cavity positioned outside of the second frequency range receiver within the housing;

a first resonator port positioned outside the first frequency range receiver through the housing; and a second resonator port positioned outside the second frequency range receiver through the housing, the first resonator cavity and the second resonator cavity further positioned to transmit sound forward into the scoop cavity via the first and second resonator ports, respectively.

2. The earphone of claim 1, wherein the first frequency range receiver is smaller in volume than the second frequency range receiver, thereby allowing the second resonator cavity to be adjacent to the first resonator cavity.

3. The earphone of claim 1, wherein the first frequency range receiver is smaller in volume than the second frequency range receiver, thereby allowing the second resonator cavity to surround the first resonator cavity.

4. The earphone of claim 1, wherein the first frequency range receiver and the second frequency range receiver are cylindrical in shape and defining a centerline, and wherein the centerlines of the first frequency range receiver and the second frequency range receiver are parallel to the normal from the ear.

5. The earphone of claim 1, wherein the first and second resonator cavities acoustically communicate with each other via the first and second resonator ports and the scoop cavity.

6. The earphone of claim 1, wherein the first frequency range receiver together with the first resonator cavity and first resonator port function as a high frequency sound delivery system, and the second frequency range receiver together with the second resonator cavity and second resonator port function as a low frequency sound delivery system.

7. The earphone of claim 6, further comprising:

an electronic circuit or function for driving a combined high frequency sound delivery system and low frequency sound delivery system.

8. The earphone of claim 7, wherein the driven combination is electrically in parallel.

9. The earphone of claim 7, wherein the electronic circuit or function comprises a high-pass filter for passively filtering the high frequency sound delivery system.

10. The earphone of claim 7, further comprising:

a communications circuit for connection to a telephone, the communications circuit electronically connected to the first frequency range receiver and the second frequency range receiver.

11. The earphone of claim 10, wherein the response of the first frequency range receiver and the response of the second frequency range receiver covers a desired sound bandwidth.

12. The earphone of claim 11, wherein the desired sound bandwidth is between about 75 Hz and about 18,000 Hz.

13. The earphone of claim 11, wherein the desired sound bandwidth is between about 75 Hz and about 14,000 Hz.

14. The earphone of claim 11, wherein the desired sound bandwidth is between about 150 Hz and about 18,000 Hz.

15. The earphone of claim 11, wherein the desired sound bandwidth is between about 150 Hz and about 14,000 Hz.

16. The earphone of claim 11, wherein the desired sound bandwidth includes frequencies above and below about 7,000 Hz, and wherein the first frequency range receiver provides all frequency response above about 7,000 Hz.

17. The earphone of claim 1, wherein the second frequency range receiver comprises a diaphragm, the diaphragm having a front and a rear surface; and wherein the first and second frequency range receivers are housed by the housing, the housing having a gap therein to allow acoustical leakage of the second frequency range receiver's sound volume velocity off the rear surface of the diaphragm of the second frequency range receiver through an auxiliary hole into an auxiliary cavity and through the gap to the ambient outside of the housing.

18. The earphone of claim 1, wherein the at least one wall of the housing further defines a side-branch resonator cavity and a side-branch resonator port, the side-branch resonator port allowing air movement between the second resonator cavity and the side-branch resonator cavity, the side-branch resonator cavity of a volume of from about 3 cc to about 12 cc, such that the side-branch resonator behaves as an acoustical response notch-type filter.

19. The earphone of claim 18, further comprising a damping material connected to the side-branch resonator port.

20. The earphone of claim 19, wherein the damping material has an acoustical resistance of from about 1 Ns per cubic meter to about 3 Ns per cubic meter.

21. The earphone of claim 1, wherein the second frequency range receiver comprises a magnetic structure having a hole therethrough, and wherein the hole in the magnetic structure of the second frequency range receiver comprises a side-branch resonator port allowing air movement between the second resonator cavity and a side-branch resonator cavity located at the termination of the side-branch resonator port.

* * * * *